US006422882B1

(12) United States Patent
May et al.

(10) Patent No.: US 6,422,882 B1
(45) Date of Patent: Jul. 23, 2002

(54) PLUG AND SOCKET CONNECTOR ARRANGEMENT WITH PLUG AND SOCKET MATING SLIDER

(75) Inventors: Guntram May, Altdorf; Harald Lutsch, Weiterstadt; Peter Nutzel, Nuremberg, all of (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/869,730

(22) PCT Filed: Jan. 4, 2000

(86) PCT No.: PCT/EP00/00020

§ 371 (c)(1),
(2), (4) Date: Jul. 3, 2001

(87) PCT Pub. No.: WO00/41273

PCT Pub. Date: Jul. 13, 2000

(30) Foreign Application Priority Data

Jan. 8, 1999 (DE) ..... 199 00 514

(51) Int. Cl.[7] ..... H01R 13/62
(52) U.S. Cl. ..... 439/157; 439/347
(58) Field of Search ..... 439/157, 347

(56) References Cited

U.S. PATENT DOCUMENTS 5,257,944 A * 11/1993 Kennedy ..... 439/347
5,618,195 A 4/1997 Cappe ..... 439/157
5,660,556 A 8/1997 Badaroux et al. ..... 439/310
5,876,226 A * 3/1999 Tsukakoshi et al. ..... 439/157
6,045,375 A * 4/2000 Aoki et al. ..... 439/157
6,142,826 A * 11/2000 Bourillon ..... 439/157
6,149,473 A * 11/2000 Lalange et al. ..... 439/157

FOREIGN PATENT DOCUMENTS

| | | |
|---|---|---|
| DE | 9205859.0 | 9/1992 |
| DE | 19530334 A1 | 2/1997 |
| DE | 3645179 C2 | 10/1997 |
| DE | 29621317 U1 | 5/1998 |
| EP | 0625809 A1 | 11/1994 |
| EP | 0801441 A1 | 10/1997 |

* cited by examiner

*Primary Examiner*—Brian Sircus
*Assistant Examiner*—Hae Moon Hyeon
(74) *Attorney, Agent, or Firm*—Perman & Green, LLP

(57) ABSTRACT

A plug and socket connector arrangement with a shaped plug and socket mating slider (1). Two parallel arms (3) grips one of the complementary parts (12) of the arrangement in order to draw it to the second complementary part (14) of the connector by actuating a guide slot (2) and a sliding block arrangement (13). The plug and socket mating slider (1) is led to a guide groove (10) in the connector arrangement, along which are arranged stopping faces (7) against which push the front faces (6) of the arms (3), provided that one of the complementary parts (12) of the connector is not inserted between the plug and socket connector mating slider (1). The complementary part (12) of the connector spreads apart the arms (3) in the process of its insertion between the arms (3) in such a way that the front faces (6) of the arms (3) are able to be moved sideways past the stopping faces (7) into their final position.

8 Claims, 4 Drawing Sheets

PLUG AND SOCKET CONNECTOR ARRANGEMENT WITH PLUG AND SOCKET MATING SLIDER

This application claims the benefit of the earlier filed International Application No. PCT/EP00/00020, International Filing Date, Jan. 4, 2000, which designated the United States of America, and which international application was published under PCT Article 21(2) in English as WO Publication No. WO 00/41273.

The present invention concerns a plug and socket connector arrangement according to preamble of the first claim. Such plug and socket connector arrangements are intended for multipolar plug and socket connectors, where even the interconnection of the complementary plug and socket parts requires a certain amount of effort. A plug and socket mating slider makes it possible for the effort which must be expended, to be spread over a longer distance so that the interconnection of the complementary plug and socket parts of the connector is made easier. It can happen in assembling such a plug and socket connector or in re-inserting previously separated complementary plug and socket parts that the plug and socket mating slider is pushed into its final position without one complementary part of the connector engaging in the guide slot provided for it and without being drawn into the other complementary part of the connector.

In this position, it is no longer possible for the complementary parts of the connector to be interconnected in such a way as to give a correct connection.

The present invention was designed to improve the plug and socket connector arrangement of the type described at the outset in such a way as to prevent the unintentional insertion of the plug and socket mating slider without a secure connection becoming established.

This task is solved in accordance with the claim and preferred embodiment forms of the present invention are specified in the subsidiary claims. The present invention is based on the principle that the plug and socket mating slider is allowed to run in an intermediate position against a stopping face, as long as one of the complementary parts of the connector is not inserted to such a point that the said complementary part of the connector can be drawn into the other complementary part of the connector by means of the surface guide slots. This only happens when one complementary part of the connector is drawn sufficiently close to the other complementary part so that the arms of the plug and socket mating slider are spread apart, enabling their front faces to be inserted further past the stopping faces.

This ensures that the complete unintentional insertion of the plug and socket mating slider without an appropriate complementary part of the connector is safely prevented.

Figure 1:
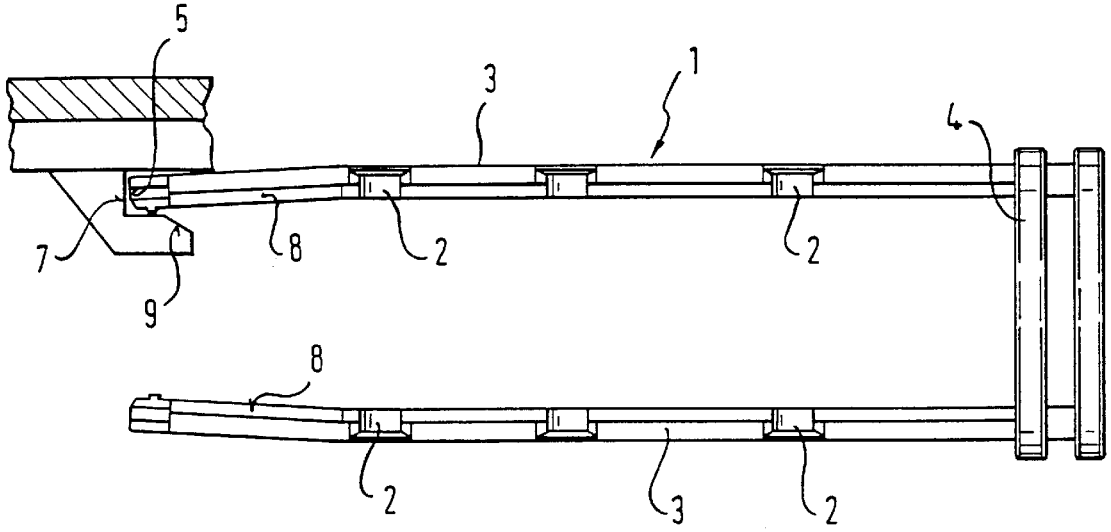
Figure 1:
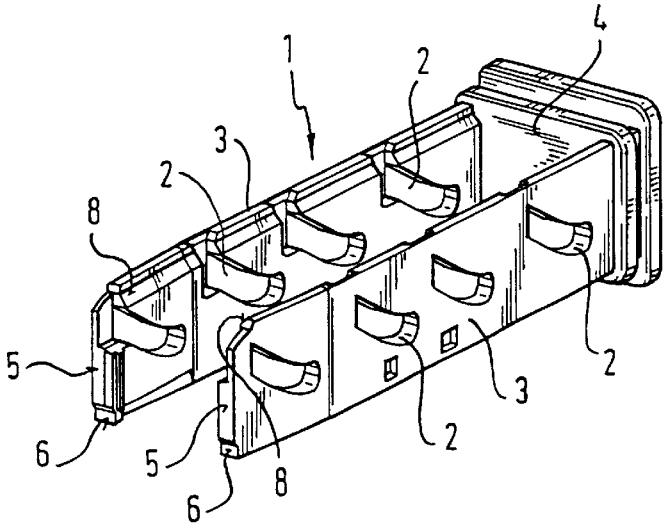
Figure 2:
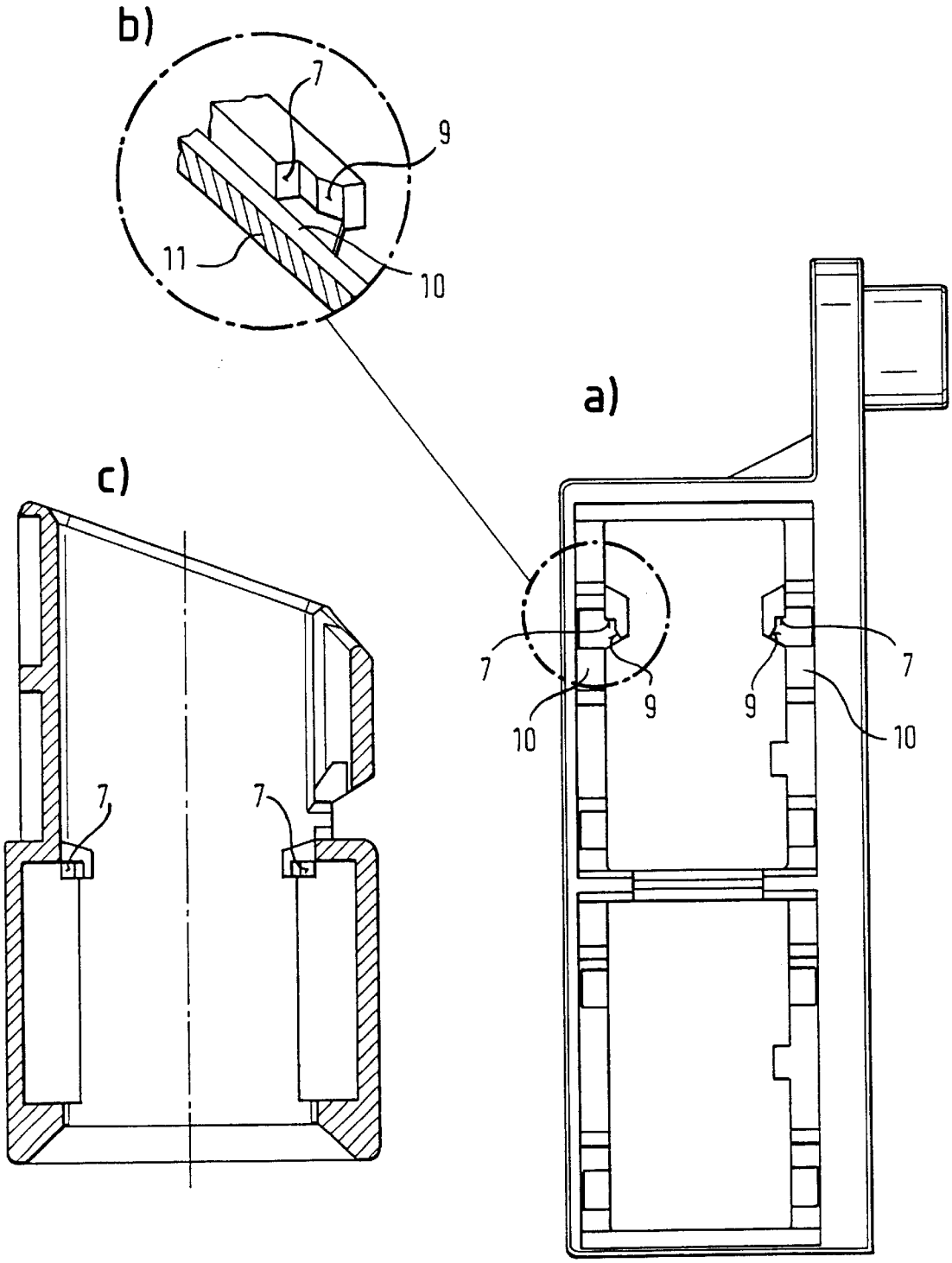
Figure 3:
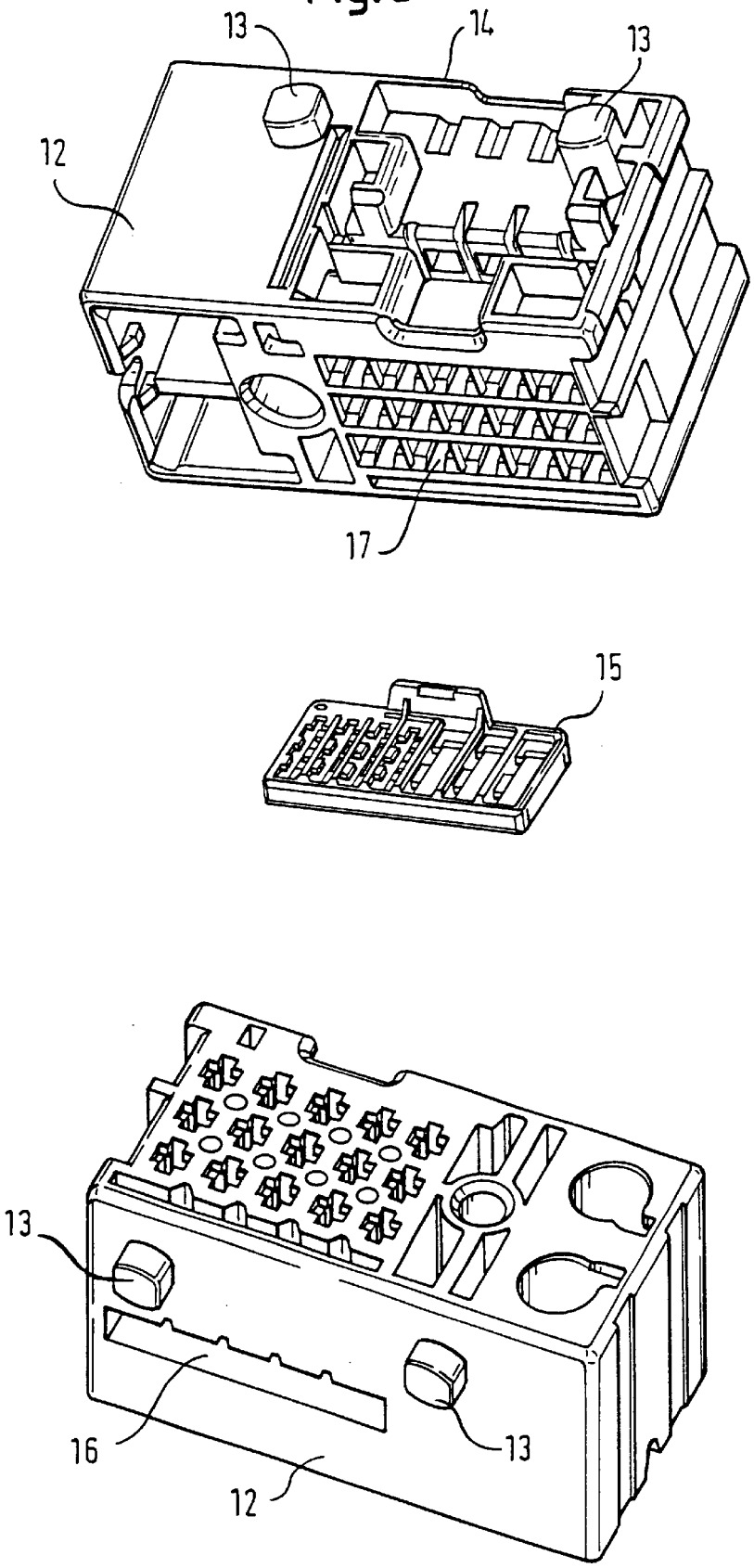
Figure 4:
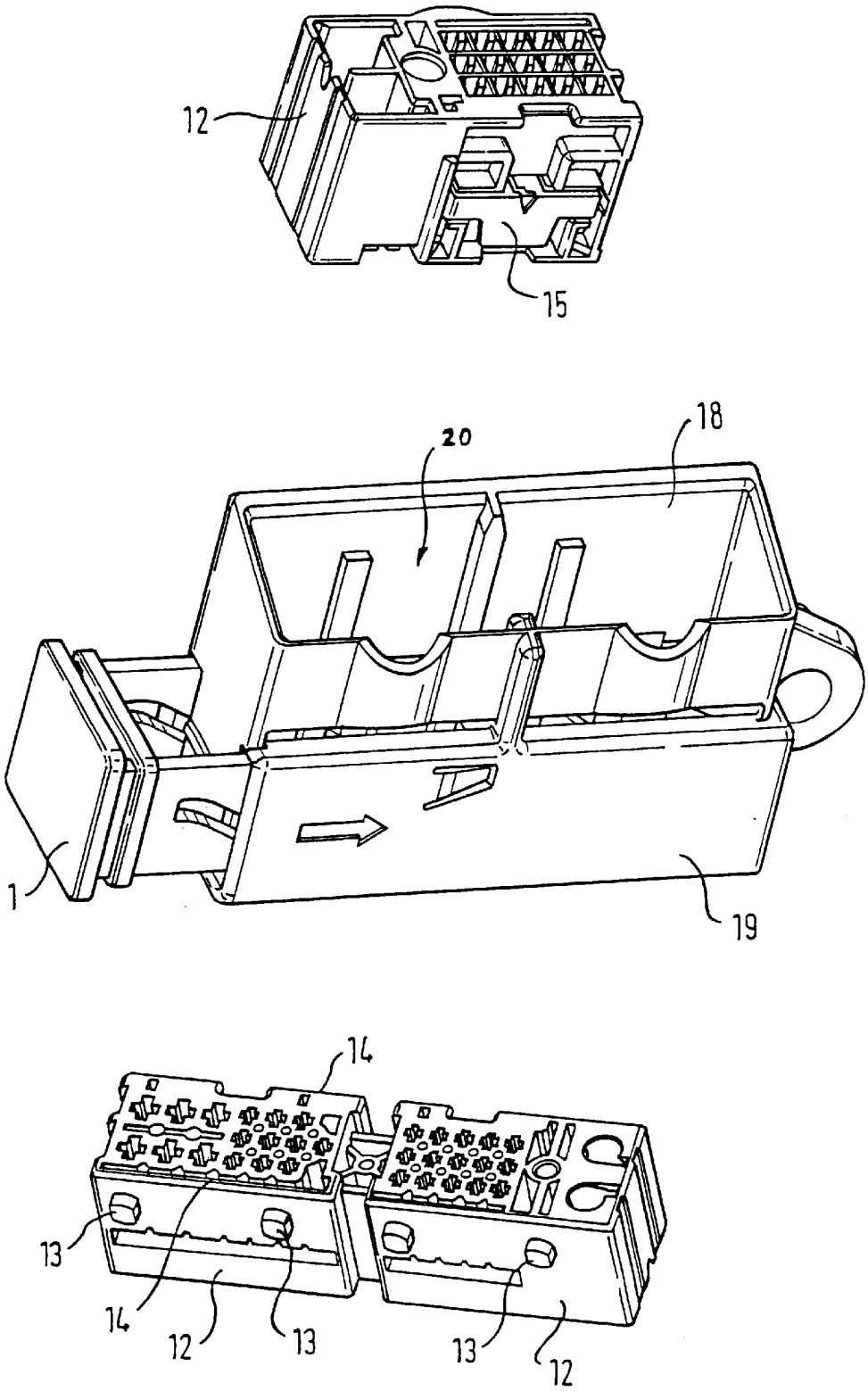

The invention will now be explained more fully by means of a description of an example of an embodiment which makes reference to the drawings. In these drawings:

FIG. 1 shows the plan view and the perspective view of a prefered embodiment example of a plug and socket mating slider, FIG. 2 shows in plan view, in side view and in perspective detail view, the arrangement of the stopping faces in the complementary part of the connector, FIG. 3 shows two perspective views of a connector module with a secondary locking device, FIG. 4 shows a perspective view of a connector module with a separate assembly frame.

The plug and socket mating slider 1 has guide slots 2 in two arms 3 which are connected at one end to an actuating surface 4. On the front faces 5 of the arms of the plug and socket mating slider 1, stopping surfaces 6 are arranged on the lower edge, crosswise to the direction of insertion which, when the plug and socket mating slider is inserted into the corresponding guide grooves in one of the complementary parts of the connector, push against a stopping face or shoulder 7 which prevents the plug and socket mating slider from being pushed into its final position without the complementary part of the connector.

In the perspective view of the plug and socket mating slider in FIG. 1 are visible the chamfered upper edges 8 whose function is explained below in greater detail. FIG. 2*a* shows the plan view of a housing which the plug and socket mating slider is pushed into. It is possible to see the stopping shoulders 7 flanked on their inner faces by the chamfered guiding faces or surfaces 9 which lead the front faces 6 precisely onto the stopping faces 7. FIG. 2*b* shows the perspective view of a detail of the stopping shoulder 7 and the guide surface 9. It can be seen that between the stopping face 7 and a housing wall 11, there runs a groove 10, along which it is possible to push the appropriate arm of the plug and socket mating slider further in the direction of its final position past the stopping face 7, when the arm has been pushed sideways away from the stopping face 7. This takes place by means of the insertion of one complementary part 12 of the connector as it is shown, for example, in FIG. 3. This complementary part 12 of the connector shows sliding blocks 13 which are inserted into the corresponding guide slots 2 in the arms of the plug and socket mating slider. When the sliding blocks 13 are inserted into the opening of the guide slots 2, the arms of the plug and socket mating slider are spread apart because the width of one of the complementary parts of the connector is somewhat greater than the distance between the two arms of the plug and socket mating slider 1. The spreading apart takes place by means of the sliding along the lower longitudinal edges 14 of one complementary part of the connector on the chamfered upper edges 8 of the arms of the plug and socket mating slider 1. FIG. 3 further shows a secondary locking device 15 which is inserted into a slot 16 specially provided for this purpose, in order to lock the contacts in their cavity 17 into their final position.

FIG. 4 shows another embodiment, in which a frame 18 receives one complementary part 12 of the connector and is inserted together with the other complementary part 19. It can be seen from FIG. 4 that there the secondary locking device 15 is inserted completely. If this is not the case, the complementary part 12 of the connector cannot be inserted completely into the cavity 20 specially provided for this purpose in the frame 18, whereby an interconnection of connectors which are not secondarily locked is not possible. In the embodiment shown at the bottom of FIG. 4, two complementary connector components which are linked together by a bridge are inserted into an appropriately shaped portion of the frame 18. This portion of the frame 18 is able to be inserted without the spreading apart of the arms of the plug and socket mating slider 1 and has open side flanks in its lower half so that in the process of insertion of the complementary parts 12 of the connector its sliding blocks can be inserted into the corresponding guide slots 2 and its edges 14 are able to spread apart the arms of the plug and socket mating slider 1. The embodiment shown provides a separate frame 18 and a further embodiment can also be contemplated, in which the frame 18 is integral with the complementary part 12 of the connector.

The sliding blocks 13 have, as can best be seen from FIG. 3, a cross-section whose form approximates to that of a rounded cuboid. The longitudinal central axis of these sliding blocks is inclined at the same angle as the guide slot, so that the surface of the sliding blocks makes available the largest possible bearing area to the inner walls of the guide slots.

So, according to the invention, the plug and socket connector arrangement can be operated easily and with only little effort being spent. Furthermore, the said plug and socket connector arrangement is safer to handle since wrong operation in terms of premature insertion can be prevented as early as the assembly or interconnection without actuating the secondary locking device or locking the plug and socket mating slider in its final position be fore a complementary part of the connector has been inserted. The embodiment example described earlier only serves to illustrate the invention and is not to be understood as being limiting in any way.

What is claimed is:

1. A plug and socket connector arrangement with a U-shaped plug and socket mating slider (1) which grips one complementary part (12) of the connector by means of two parallel arms (3) in order to draw it into a second complementary part (14) of the connector by means of actuating a guide slot and a sliding block arrangement (13), wherein the plug and socket mating slider (1) in the plug and socket connector arrangement is led into a guide groove (10) along which stopping faces (7) are arranged and against which the front faces (6) of arms (3) push, as long as one complementary part (12) of the connector is not inserted between arms (3) of the plug and socket mating slider and the complementary part (12) of the connector, and when the complementary part is being introduced between the arms (3) of the plug and socket mating slider (1), the arms are spread apart in such a way that the front faces (6) of the arms (3) are able to be moved sideways past the stopping faces (7) as far as their final position.

2. A plug and socket connector arrangement according to claim 1, wherein the arms (3) of the plug and socket mating slider (1) are chamfered on their inner sides (8) where the complementary part (12) of the connector is introduced between the arms (3).

3. A plug and socket connector arrangement according to claim 1, wherein the stopping faces have a shoulder which is vertical to the direction of insertion of the plug and socket mating slider and a chamfered guide surface (9) in the direction of insertion.

4. The plug and socket connector arrangement according to claim 1, wherein the plug and socket mating slider (1) have guide slots and that one of the complementary parts (12) of the connector has sliding blocks (13).

5. The plug and socket connector arrangement according to claim 1, wherein the connector has a frame (18) into which the complementary part (12) of the connector is inserted together with a secondary locking device (15).

6. The plug and socket connector arrangement according to claim 5 wherein the frame (18) prevents, by the stopping face, the insertion of the module which does not have a fully inserted secondary locking device (15).

7. The plug and socket connector arrangement according to claim 1, wherein the plug and socket mating slider has guide slots with walls on either side of the guide slots and the sliding blocks (13) are of a shape such that their overall surface makes available the largest possible bearing surface on the walls of the guide slot (2).

8. The plug and socket connector arrangement according to claim 7, wherein the cross-section of the sliding blocks (13) has the shape of a rounded cuboid with the same inclination as that of the guide slot (2) whose longitudinal sides are parallel to the. walls of the guide slot (2).

* * * * *